US009468801B2

(12) United States Patent
Matsushita

(10) Patent No.: US 9,468,801 B2
(45) Date of Patent: Oct. 18, 2016

(54) IMPLEMENT FOR TRAINING FACIAL MUSCLE

(71) Applicant: MTG CO., LTD., Nagoya-shi, Aichi-ken (JP)

(72) Inventor: Tsuyoshi Matsushita, Nagoya (JP)

(73) Assignee: MTG CO., LTD., Nagoya-Shi (JP)

( * ) Notice: Subject to any disclaimer, the term of this patent is extended or adjusted under 35 U.S.C. 154(b) by 0 days.

(21) Appl. No.: 14/435,713

(22) PCT Filed: Oct. 29, 2013

(86) PCT No.: PCT/JP2013/079258

§ 371 (c)(1),
(2) Date: Apr. 14, 2015

(87) PCT Pub. No.: WO2014/069454

PCT Pub. Date: May 8, 2014

(65) Prior Publication Data

US 2015/0283426 A1 Oct. 8, 2015

(30) Foreign Application Priority Data

Oct. 30, 2012 (JP) ..... 2012-239213

(51) Int. Cl.

*A63B 23/03* (2006.01)
*A63B 21/06* (2006.01)
*A63B 21/00* (2006.01)
(Continued)

(52) U.S. Cl.

CPC ..... *A63B 23/032* (2013.01); *A63B 21/002* (2013.01); *A63B 21/0004* (2013.01); *A63B 21/0023* (2013.01); *A63B 21/00061* (2013.01); *A63B 21/026* (2013.01); *A63B 21/06* (2013.01); *A63B 21/065* (2013.01); *A63B 21/0615* (2013.01)

(58) Field of Classification Search

CPC .. A63B 23/03; A63B 23/032; A63B 23/025; A63B 71/085; A63B 2071/086; A63B 2071/088; A61F 5/50; A61F 5/56; A61F 5/566; A61F 5/58; A61C 7/36
USPC ..... 128/848, 859–862
See application file for complete search history.

(56) References Cited

U.S. PATENT DOCUMENTS 779,360 A * 1/1905 Grummann ..... A61F 5/58 600/24
1,439,910 A * 12/1922 Posa ..... A45D 44/22 606/204.15

(Continued)

FOREIGN PATENT DOCUMENTS

DE 34 33 356 A1 3/1986
FR 1111489 A 2/1956

(Continued)

OTHER PUBLICATIONS

Supplementary European Search Report dated May 25, 2016 as received in Application No. 13850387.5.

*Primary Examiner* — Loan H Thanh
*Assistant Examiner* — Rae Fischer
(74) *Attorney, Agent, or Firm* — Maschoff Brennan

(57) ABSTRACT

The facial muscle exercising device (20) is provided with an elastically deformable bending portion (21) and a mouth-held portion (24), which is installed at the center of the bending portion (21) and held by the lips. The mouth-held portion (24) is located outside an edge portion of the bending portion (21).

14 Claims, 13 Drawing Sheets

(51) Int. Cl.

| | |
|---|---|
| ***A63B 21/002*** | (2006.01) |
| ***A63B 21/065*** | (2006.01) |
| ***A63B 21/02*** | (2006.01) |

(56) References Cited

U.S. PATENT DOCUMENTS

| | | | | |
|---|---|---|---|---|
| 3,091,237 | A * | 5/1963 | Skinner | A61H 9/0078 128/DIG. 20 |
| 3,805,771 | A | 4/1974 | Wright | |
| 6,406,404 | B1 | 6/2002 | Chu | |
| 6,406,405 | B1 | 6/2002 | Chu | |
| 2003/0073542 | A1 | 4/2003 | Patton | |
| 2009/0018582 | A1 | 1/2009 | Ishikawa et al. | |
| 2010/0151997 | A1 | 6/2010 | Campbell | |

FOREIGN PATENT DOCUMENTS

| | | | |
|---|---|---|---|
| JP | 2003-299702 | A | 10/2003 |
| JP | 1223289 | * | 10/2004 |
| JP | 1223289 | S | 11/2004 |
| JP | 2008-067732 | A | 3/2008 |
| JP | 2010-264132 | A | 11/2010 |
| TW | 550104 | B | 9/2003 |

* cited by examiner

IMPLEMENT FOR TRAINING FACIAL MUSCLE

FIELD OF THE INVENTION

The present invention relates to a facial muscle exercising device which is used for exercising facial muscles such as mimetic muscles on the face of the human body.

BACKGROUND OF THE INVENTION

Conventionally, this type of facial muscle exercising device includes, for example, a configuration disclosed in Patent Document 1. The facial muscle exercising device of Patent Document 1 is provided with a band-shaped elastic plate composed of a long and narrow leaf spring. A mouth-held portion which is held by the lips is installed at the center of the elastic plate in the long direction. A pair of weight portions is fixed at the ends of the elastic plate. In a state in which the mouth-held portion is held by the lips, both weight portions are allowed to sway vertically via the leaf spring. As described above, a reaction force, etc., due to sway of the weight portions is transmitted to the mouth-held portion as a load to exercise facial muscles such as mimetic muscles.

PRIOR ART DOCUMENT

Patent Document

Patent Document 1: Design Registration No. 1223289

SUMMARY OF THE INVENTION

However, in the conventional facial muscle exercising device, the mouth-held portion is installed on the elastic plate. Therefore, a user has to hold the elastic plate to position the elastic plate between the upper and lower lips of the user. In this state, the elastic plate is held stably together with the mouth-held portion by the lips, and loads of the weight portions will not act effectively as a load on exercising of facial muscles. As a result, the conventional facial muscle exercising device is insufficient in providing excellent exercising effects on facial muscles.

An object of the present invention is to provide a facial muscle exercising device which is capable of realizing excellent exercising effects on facial muscles.

In order to solve the above-described problems, a first mode of the present invention is provided with a bending portion which is elastically deformable and a mouth-held portion which is arranged at the center of the bending portion and held by the lips, in which the mouth-held portion is located outside an edge portion of the bending portion.

When using the facial muscle exercising device, a user allows a weight portion to sway vertically via an elastic plate, with the mouth-held portion held by the lips. Then, a repulsive force of the weight portion due to the sway is transmitted to the mouth-held portion to exercise facial muscles such as mimetic muscles. Further, according to the facial muscle exercising device, the mouth-held portion is located outside an edge portion of the bending portion. Therefore, the facial muscle exercising device is held by the lips in a cantilever state. Thereby, loads of the bending portion including the weight portion act effectively as a load on facial muscles, thus making it possible to effectively exercise facial muscles.

In the above-described facial muscle exercising device, it is preferable that the bending portion is constituted with a leaf spring. According to this constitution, an elastic force of the leaf spring can be used to realize effective exercising effects.

In the above-described facial muscle exercising device, it is preferable that the mouth-held portion is constituted with a core which is fixed to the leaf spring and a mouth piece which is attached outside the core in a detachable manner. According to the constitution, the mouth piece formed in an appropriate shape can be used depending on the shape of the lips, etc.

In the above-described facial muscle exercising device, it is preferable that the weight portion is arranged at both ends of the leaf spring. According to the constitution, the leaf spring can be bent appropriately by loads of the weight portions to realize effective exercising effects.

In the above-described facial muscle exercising device, it is preferable that a weight is attached to the weight portion in a detachable manner. According to the constitution, it is possible to use the weight having appropriate weight for a user.

In the above-described facial muscle exercising device, it is preferable that a portion of the mouth-held portion to be touched by the lips is located outside a line that connects width ends of the weights. According to the constitution, the facial muscle exercising device can be held in a cantilever state to obtain effective exercising effects.

DETAILED DESCRIPTION OF THE PREFERRED EMBODIMENTS

First Embodiment

Hereinafter, a description will be given of the facial muscle exercising device of a first embodiment, with reference to FIG. 1 to FIG. 13. On description of the facial muscle exercising device, the face side of a user is to be the front.

Figure 1:
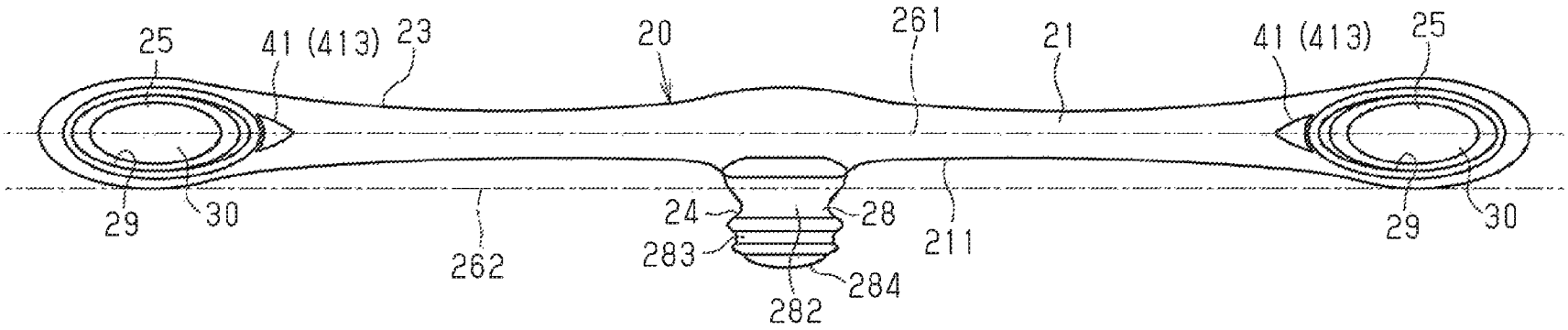
FIG. 1 is a plan view which shows a facial muscle exercising device of a first embodiment in the present invention.
Figure 2:
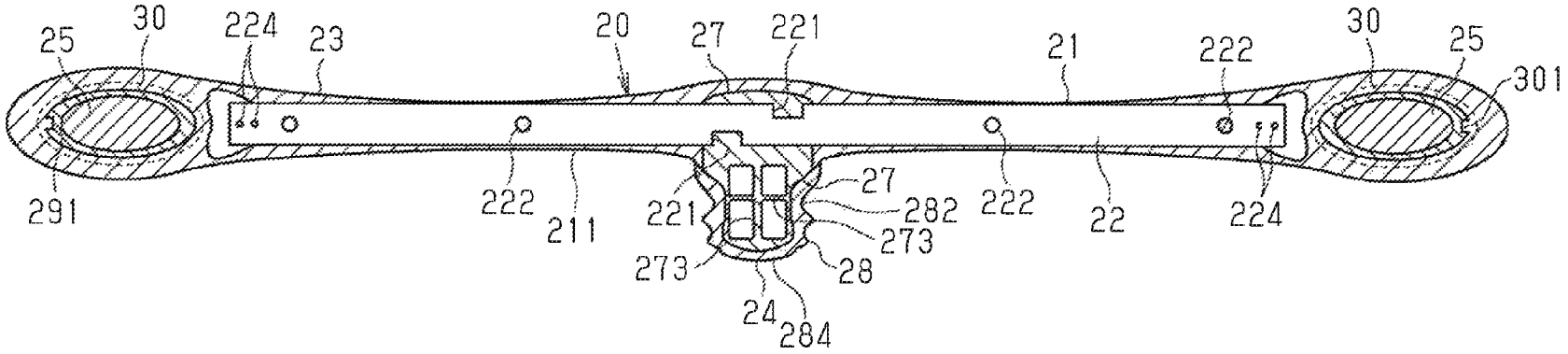
FIG. 2 is a sectional view of the facial muscle exercising device.
Figure 3:
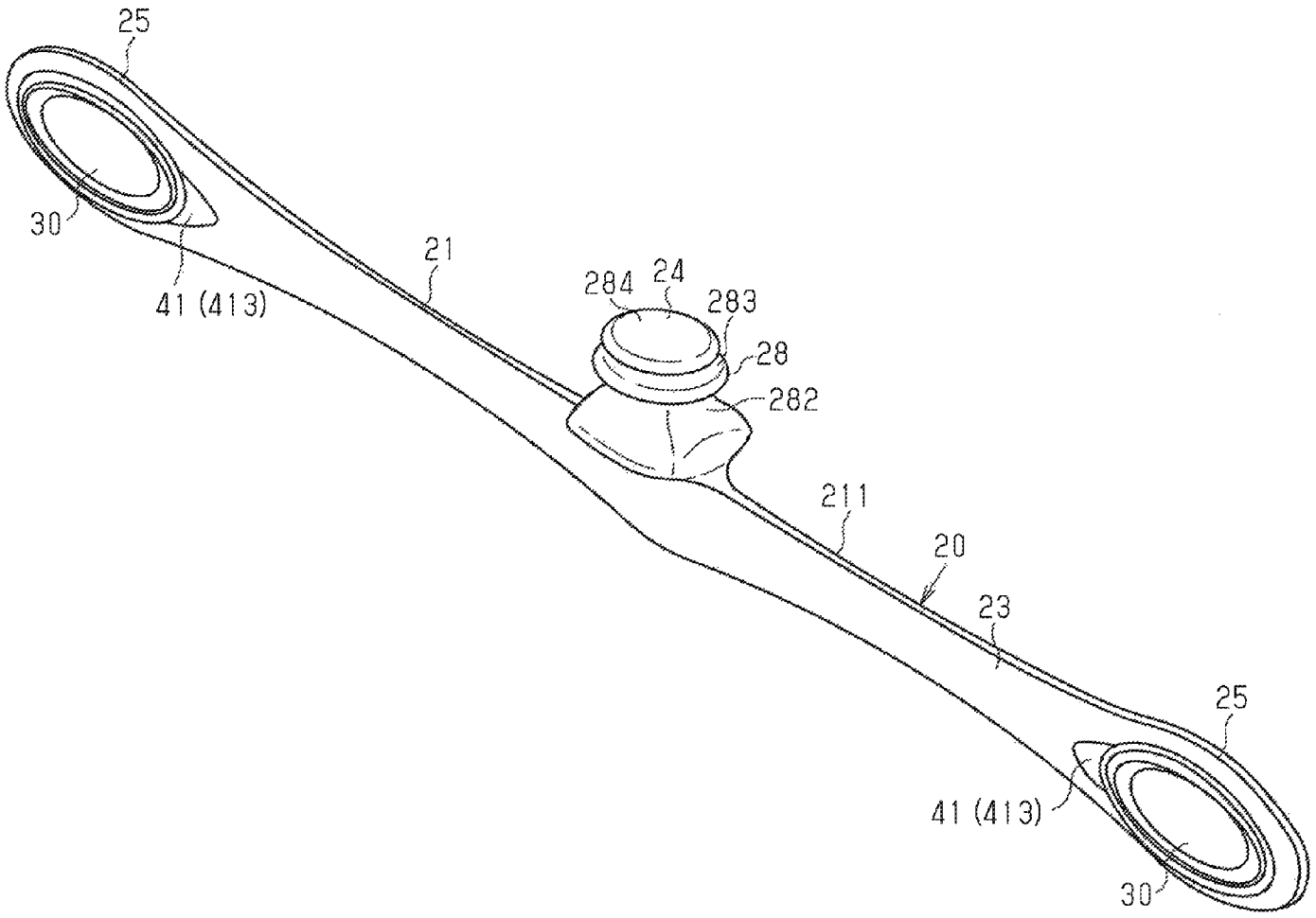
FIG. 3 is a perspective view of the facial muscle exercising device.

As shown in FIG. 1 to FIG. 3, a facial muscle exercising device 20 is provided with a bending portion 21 which is formed in a long and narrow plate shape. A mouth-held portion 24 with a circular cross section which is held by the lips is installed to project at the center of the bending portion 21 in the long direction. A weight portion 25 is installed at both ends of the bending portion 21. The mouth-held portion 24 is located to displace to the front from a straight line 261 passing through gravity centers of the weight portions 25 and projected outside to the front from a front edge 211 of the bending portion 21 on the face side of a user.

Figure 4:
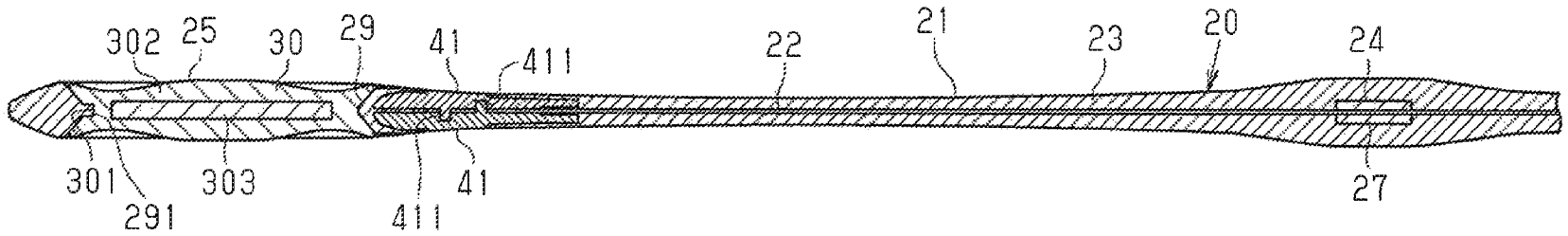
FIG. 4 is a partial sectional view of the facial muscle exercising device.
Figure 5:
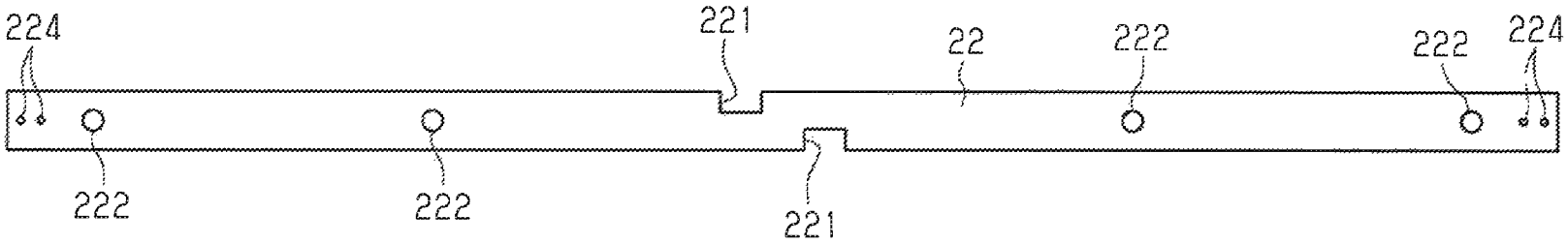
FIG. 5 is a plan view of an elastic plate.

As shown in FIG. 2, FIG. 4 and FIG. 5, the bending portion 21 is provided with a long and narrow elastic plate 22 made of a steel leaf spring. The elastic plate 22 is formed in a straight-line band shape. A core 27 is firmly attached at the center of the elastic plate 22 in the long direction. The core 27 projects outside to the front from the elastic plate 22 toward a direction orthogonal to the long direction of the elastic plate 22. A substantial entirety of the elastic plate 22 and a base end portion of the core 27 are covered by a covering material 23. The core 27 is made of a mixture resin (PC/ABS) of polycarbonate/acrylonitrile/butadiene/styrene. The covering material 23 is made of a polycarbonate (PC) resin. The core 27 is harder than the covering material 23. The elastic plate 22 is provided with a notch 221, which allows a synthetic resin constituting the core 27 on molding the core 27 to enter, thereby preventing the core 27 from moving to the elastic plate 22 and a hole 222, which allows a synthetic resin constituting the covering material 23 on molding the covering material 23 to enter, thereby preventing a relative movement between the elastic plate 22 and the covering material 23. Therefore, a relative movement between the elastic plate 22, the core 27 and the covering material 23 is prevented.

Figure 6:
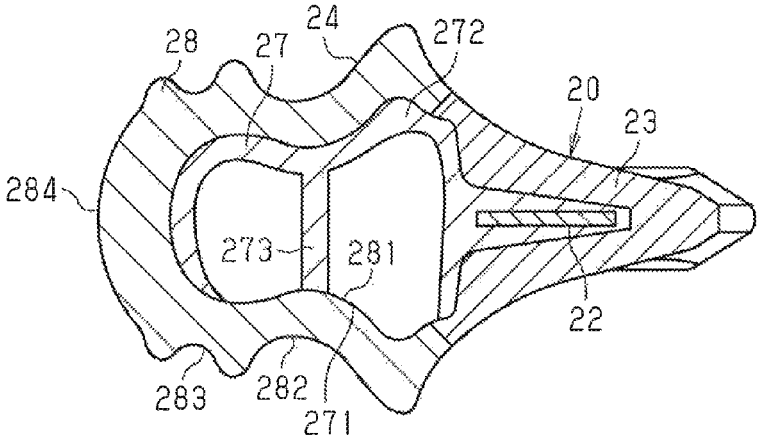
FIG. 6 is a longitudinal sectional view of a mouth-held portion.
Figure 7:
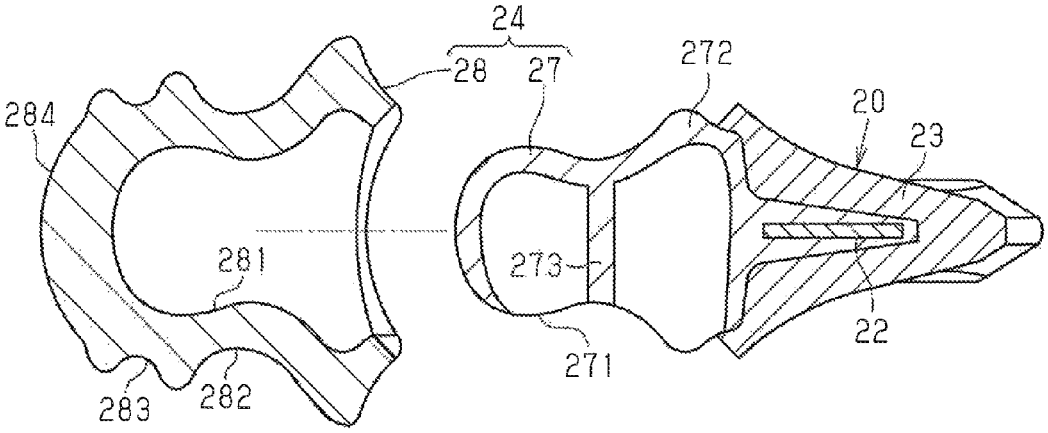
FIG. 7 is an exploded sectional view of the mouth-held portion.
Figure 8:
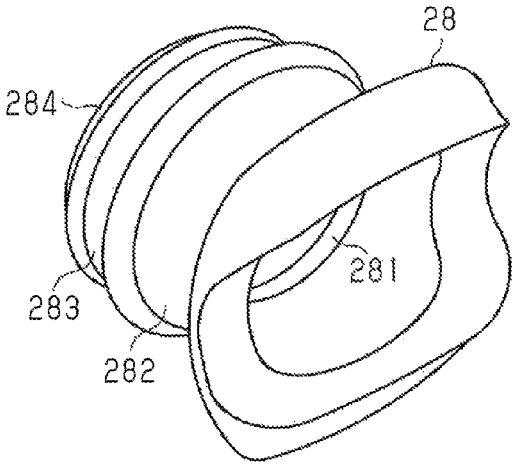
FIG. 8 is a perspective view of a mouth piece.
Figure 9:
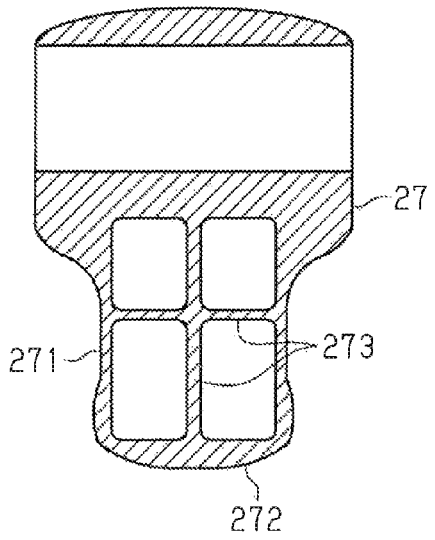
FIG. 9 is a transverse sectional view of the mouth-held portion.

As shown in FIG. 3, FIG. 6 to FIG. 9, the core 27 is provided with a hollow projection portion 272, an opening of which faces downward in FIG. 6 and FIG. 7. A rib 273 for decreasing deformation of the projection portion 272 is formed inside the projection portion 272. A mouth piece 28 is attached outside the projection portion 272 in a detachable manner. Since the projection portion 272 is made open below, a contact area between the projection portion 272 and the mouth piece 28 is decreased to reduce a frictional resistance on attachment of the mouth piece 28 in a detachable manner. As a result, the mouth piece 28 can be easily attached in a detachable manner. It is acceptable that the projection portion 272 is made open above, made open at both upper and lower ends, and made open at one side or at both sides in a lateral direction. It is also acceptable that an annular recessed portion is formed on an outer circumference of the projection portion 272 to keep an entire circumference open. Where an outer circumferential face is made open, a contact area between the core 27 and the mouth piece 28 is decreased to reduce the frictional resistance on attachment of the mouth piece 28 in a detachable manner.

The mouth piece 28 is more flexible than the core 27 and formed of an elastic rubber material. The mouth-held portion 24 is constituted with the core 27 and the mouth piece 28. A retainer 271 having a recessed portion and a raised portion is formed on an outer circumferential face of the projection portion 272. A retainer 281 corresponding to the retainer 271 to give a recessed and raised relationship is formed on an inner circumferential face of the mouth piece 28. Surface roughening such as satin-like finish is given at least to one of the outer circumferential faces of the projection portion 272 and the inner circumferential face of the mouth piece 28. Thereby, a frictional resistance on attachment of the mouth piece 28 to the core 27 in a detachable manner is reduced.

A first dent 282, which is held by the lips, is formed on the outer circumferential face of the mouth piece 28. The first dent 28 is spaced away outside from a front edge of the covering material 23, that is, a front edge 211 of the bending portion 21. A second dent 283, which can be touched by the tip of the tongue, is formed at the tip of the outer circumferential face of the mouth piece 28. A tip face of the mouth piece 28 is a spherical face 284. In the first embodiment, a plurality of mouth pieces 28 different in height, diameter or hardness, are provided, and a suitable mouth piece 28 is selected according to the size, shape, etc., of the mouth of a user.

Figure 10:
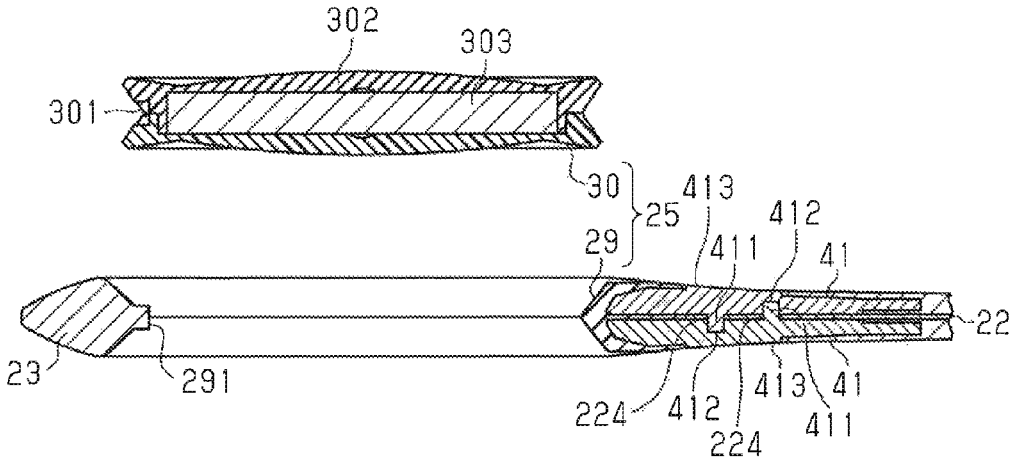
FIG. 10 is an exploded sectional view of a weight portion.
Figure 11:
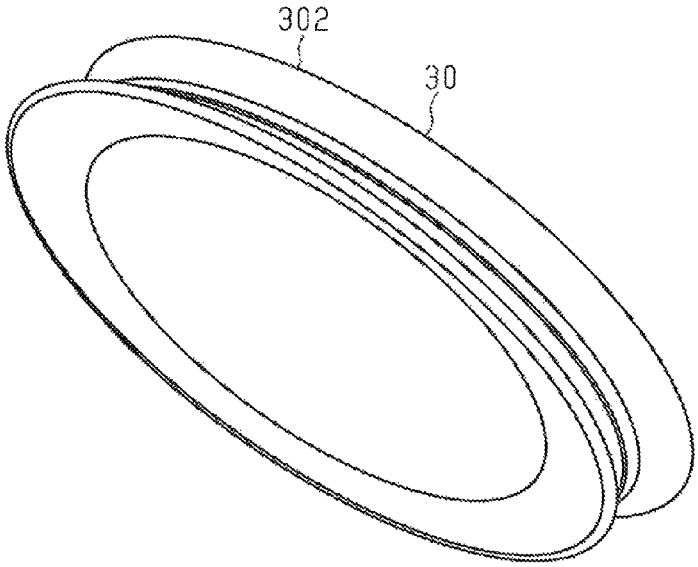
FIG. 11 is a perspective view of a weight.

As shown in FIG. 3, FIG. 10 and FIG. 11, the covering material 23 is formed thicker at the ends than at other portions. An oblong retaining hole 29 is formed at both ends of the covering material 23. An oblong weight 30 is attached into the retaining hole 29 in a detachable manner. Each of the weight portions 25 is constituted with a thick portion of the covering material 23 and the weight 30. As shown in FIG. 1, the first dent 282 of the mouth piece 28 is positioned outside a straight line 262, which connects between width ends of the weight portions 25.

In order to retain the weight 30 inside the retaining hole 29, an inner circumferential face of the retaining hole 29 is formed in the shape of an angle cross section. Further, an outer circumferential face of the weight 30 is formed in the shape of a valley cross section to be fitted into the inner circumferential face of the retaining hole 29. Surface roughening such as satin-like finish is given to one or both of the inner circumferential face of the retaining hole 29 and the outer circumferential face of the weight 30. Thereby, a frictional resistance on attachment of the weight 30 into the retaining hole 29 in a detachable manner is reduced. A protrusion 291 is also formed at one end portion of the retaining hole 29. Further, a recessed portion 301, into which the protrusion 291 can be fitted, is formed at one end portion of the weight 30. The protrusion 291 is fitted into the recessed portion 301, by which the weight 30 is less likely to drop from the inside of the retaining hole 29 when the elastic plate 22 bends. It is acceptable that the protrusion 291 and the recessed portion 301 are formed respectively in the retaining holes 29 and the weights 30 at both ends. Alternatively, it is acceptable that the protrusion 291 and the recessed portion 301 are not installed, if the weight 30 can be retained by a frictional force between the inner circumferential face of the retaining hole 29 and the outer circumferential face of the weight 30.

The weight 30 is constituted with a case 302 and a metal material 303, which is housed inside the case 302. In the first embodiment, a plurality of weights 30, which are different in the size of the metal material 303 and different in weight due to the quality of the metal material 303, are provided. A user selects a weight 30 having any given weight and attaches the thus selected weight 30 into the retaining hole 29. The case 302 is formed of a synthetic resin harder than the covering material 23.

Figure 12:
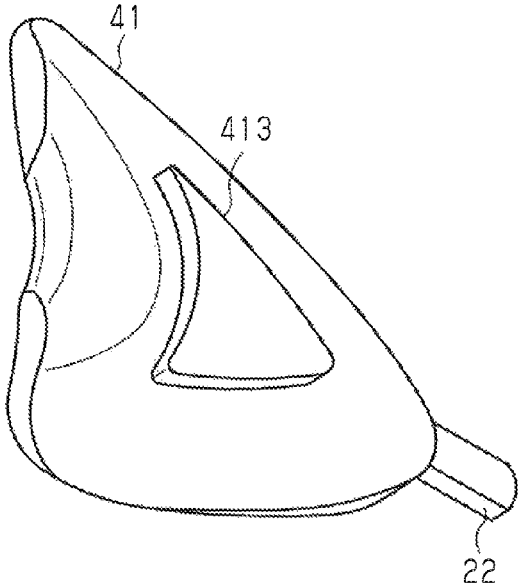
FIG. 12 is a perspective view of a protective piece.
Figure 13:
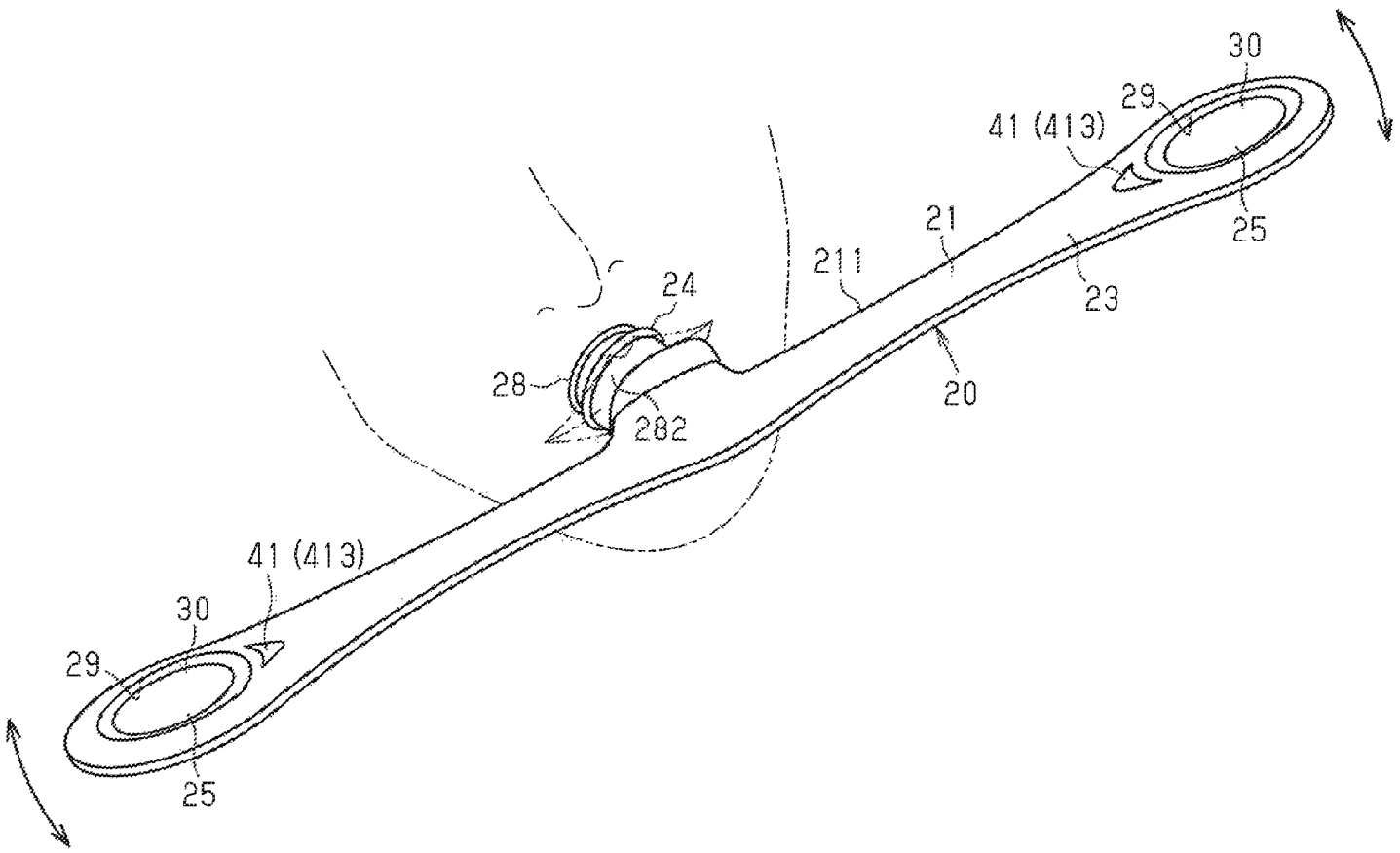
FIG. 13 is a perspective view which shows a state that the facial muscle exercising device is in use.

As shown in FIG. 3, FIG. 12 and FIG. 13, a single protective piece 41 made of a hard PC resin is attached at each of the elastic plate 22 at the ends. The protective piece 41 covers an edge of the elastic plate 22 at the ends, by which the covering material 23 is prevented from being broken at a portion of an edge by stress starting at the edge, the covering material 23 is prevented from having cracks, etc., or a corner of the elastic plate 22 at a free end is prevented from being curved by an external force. The protective piece 41 reduces shrinkage of a synthetic resin upon complete molding of the covering material 23 at both ends, at which the covering material 23 is thickly formed.

As shown in FIG. 4, FIG. 10, FIG. 12 and FIG. 13, each of the protective pieces 41 is provided with a protrusion 411 and a hole 412. The protrusion 411 of one protective piece 41 passes through the hole 224 of the elastic plate 22 and is fitted into the hole 412 of the other protective piece 41. Thereby, both the protective pieces 41 are connected to each other via the elastic plate 22. A raised portion 413 is formed on a surface of the protective piece 41. The protective piece 41 is molded inside the covering material 23, except for the raised portion 413. The raised portion 413 is exposed on the surface of the covering material 23 to form the same surface with the covering material 23. The thus exposed raised portion 413 gives accents of design.

Next, a description will be given of actions of the above-constituted facial muscle exercising device 20.

Where using the facial muscle exercising device 20, a user attaches any given mouth piece 28 that is large enough to be held by the projection portion 272 of the core 27, as shown in FIG. 7. In this connection, the user attaches the weight 30 with any given weight into the retaining hole 29 of each of the weight portions 25, as shown in FIG. 10. In this state, as shown in FIG. 13, the user holds the first dent 282 of the mouth-held portion 24 by the lips without holding the mouth-held portion 24 by the teeth. With this state kept, the user reciprocates the face in the vertical direction. As a result, via the bending portion 21, the weight portions 25 are swayed vertically, and a repulsive force due to the sway is transmitted to the mouth-held portion 24. At this time, a load resulting from loads of the weight portions 25 and a load or the like, resulting from repulsion of the bending portion 21, act on the lips and facial muscles such as mimetic muscles in the vicinity of the lips. Thereby, the facial muscles are exercised.

In this case, as shown in FIG. 1, the first dent 282 of the mouth-held portion 24 is located so that the front edge 211 of the bending portion 21 projects outside to the front. Therefore, the facial muscle exercising device 20 is held by the lips in a cantilever state. Thereby, the lips will receive a large load. As a result, loads of the weight portions 25 act efficiently as a load to the facial muscles, thereby exercising the facial muscles effectively.

Further, where the facial muscle exercising device 20 is used by a different user, the mouth piece 28 on the core 27 may be exchanged for a mouth piece 28 suitable for the user. Thus, any user different in size and shape of the mouth is able to use commonly a main-body portion of the facial muscle exercising device 20 except for the mouth piece 28.

Still further, depending on physical conditions of a user, strength of facial muscles, degree of exercise and others, the weight portion 25 can be changed in weight without any restriction. In this case, it will be sufficient that the weight 30 inside the retaining hole 29 of the weight portion 25 is exchanged for another weight 30 different in weight.

As described above, the facial muscle exercising device 20 of the first embodiment is formed such that the mouth-held portion 24 held by the lips projects outside to the front from the front edge 211 of the bending portion 21. Therefore, the facial muscle exercising device 20 is held by the lips in a cantilever state. Thereby, loads of the weight portions 25 effectively act as a load to the lips, in other words, to facial muscles. It is, thus, possible to exercise the facial muscles effectively.

The elastic plate 22 is constituted with a leaf spring. According to this constitution, elastic deformation of the leaf spring can be used to effectively sway the weight portions 25. It is, thus, possible to realize high exercising effects.

The weight 30 can be exchanged to adjust the weight of the weight portion 25. Therefore, it is possible to change the degree of a load to facial muscles depending on physical conditions of a user and degree of exercise without any restriction.

The elastic plate 22 is covered with the covering material 23. Therefore, it is possible to prevent development of rust on the elastic plate 22 and also realize an excellent design.

The mouth-held portion 24 is formed in a protrusion shape with a circular cross section. Therefore, a user is able to easily hold the mouth-held portion 24. In contrast, where the mouth-held portion is formed in a plate shape, a user may have a difficulty in holding the mouth-held portion 24 in some cases.

The mouth-held portion 24 is constituted with the core 27 formed on the covering material 23 and the mouth piece 28 attached to the core 27 in a detachable manner. Thus, the plurality of mouth pieces 28 different in size, etc., is provided, and a user is able to use a mouth piece 28 suitable in size depending on the size of the mouth of the user, etc.

The core 27 is formed to be hollow, with the lower part thereof made open. Thus, a frictional force between the core 27 and the mouth piece 28 is decreased, and the mouth piece 28 can be easily attached in a detachable manner.

The weight portion 25 is constituted with the retaining hole 29, which is formed on the covering material 23, and the weight 30, which is attached into the retaining hole 29 in a detachable manner. Therefore, the plurality of weights 30 different in weight is provided, and any given weight 30 can be attached into the retaining hole 29 in a detachable manner. It is, thereby, possible to easily adjust the weight of the weight portion 25 depending on the degree of exercise, etc.

A user applies a force to the core 27 via the mouth piece 28, by which the elastic plate 22 repeats bending movements on the basis of the core 27. In this case, the core 27 is formed of a hard resin and, therefore, hardly undergoes deformation. As a result, the force of the user is directly applied via the core 27 to the elastic plate 22 and the weight portions 25 at the ends thereof. Thus, the user is able to operate the facial muscle exercising device 20 at will. Since the core 27 is sufficient in rigidity and strength, it is great in strength and can be used many times.

Second Embodiment

Next, a description will be given of a facial muscle exercising device 20 of a second embodiment, with an emphasis given to portions different from those of the first embodiment, by referring to FIG. 14 and FIG. 15.

Figure 14:
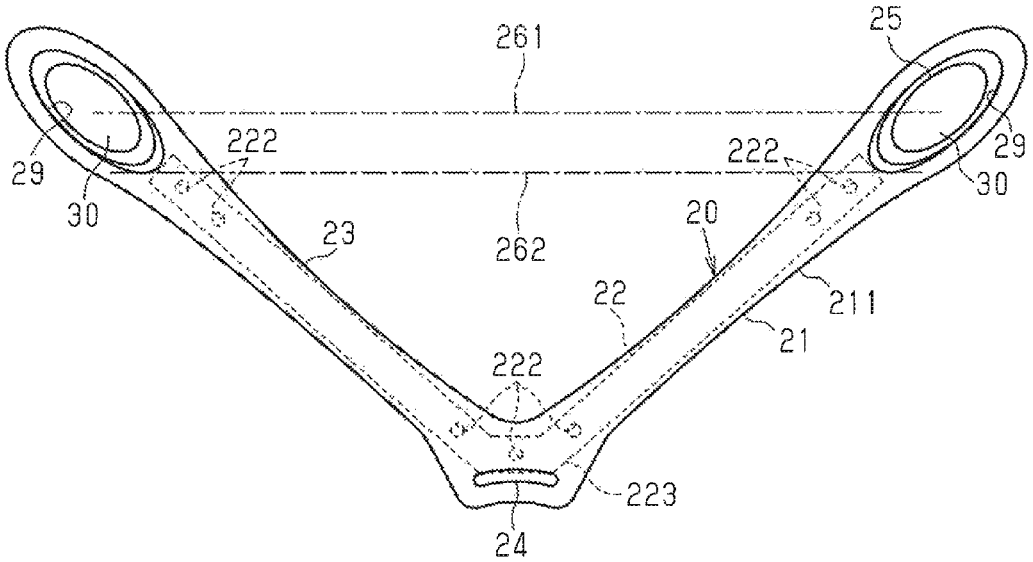
FIG. 14 is a plan view which shows a facial muscle exercising device of a second embodiment in the present invention.
Figure 15:
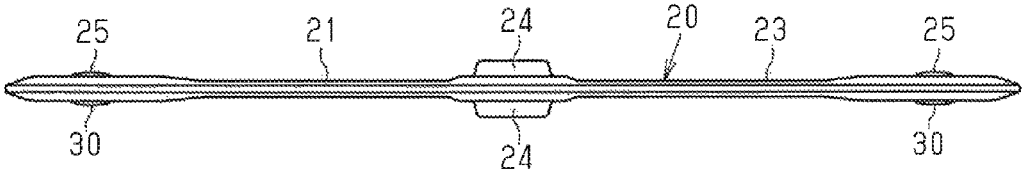
FIG. 15 is a front elevational view of the facial muscle exercising device.

As shown in FIG. 14 and FIG. 15, a bending portion 21 is provided with an elastic plate 22 and formed in an angle shape. A mouth-held portion 24 is located at a corner portion 223 of the elastic plate 22. The mouth-held portion 24 projects from both upper and lower faces of a covering material 23. As shown in FIG. 14, the mouth-held portion 24 projects outside to the front from a front edge 211 of the bending portion 21 and is also located to displace to the front from a straight line 261 connecting the gravity centers of both weight portions 25 and from a straight line 262 passing through width ends of both weights 30.

According to the second embodiment, the mouth-held portion 24 is located at the corner portion 223 of the elastic plate 22. Therefore, unlike the first embodiment in which the elastic plate 22 is formed in a straight line, the necessity of allowing the mouth-held portion 24 to project from an upper part of the elastic plate 22 is eliminated. In other words, it is sufficient that the mouth-held portion 24 is directly installed at the corner portion 223 of the elastic plate 22 formed in an angle shape. Thus, the mouth-held portion 24 can be made simple in structure.

The single weight portion 25 is installed at each of the ends of the elastic plate 22, which is formed in an angle shape. Therefore, the weight portion 25 is spaced to the front distant from the mouth-held portion 24. As a result, a load of the weight portions 25 to facial muscles is increased and exercise can be performed more effectively.

Since the elastic plate 22 is formed in an angle shape, the facial muscle exercising device 20 can be decreased in width in the lateral direction. It is, thus, possible to downsize the facial muscle exercising device 20.

Modified Embodiments

It is acceptable that the first and second embodiments are modified as shown in FIG. 16 to FIG. 21. In any of these modified embodiments, a mouth-held portion 24 projects outside to the front from a front edge 211 of a bending portion 21.

Figure 16:
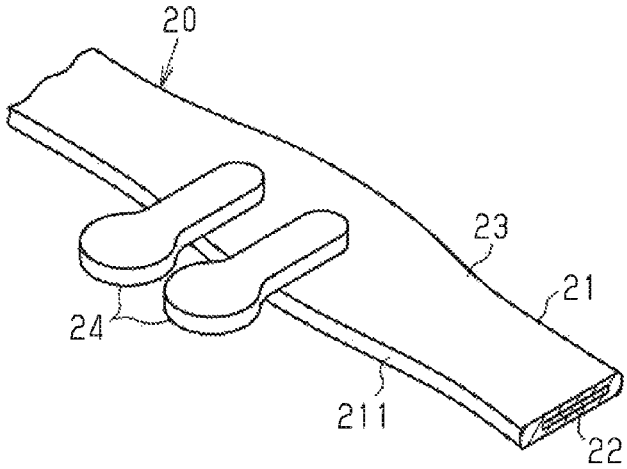
FIG. 16 is a partial perspective view which shows a first modified embodiment of the facial muscle exercising device.

In the constitution shown in FIG. 16, a pair of mouth-held portions 24 in the lateral direction, each of which is formed substantially in a circular shape, is formed on a covering material 23. Each of the mouth-held portions 24 projects to the front from the center of an upper face of the covering material 23. According to the above-described constitution, the mouth-held portions 24 can be held stably.

Figure 17:
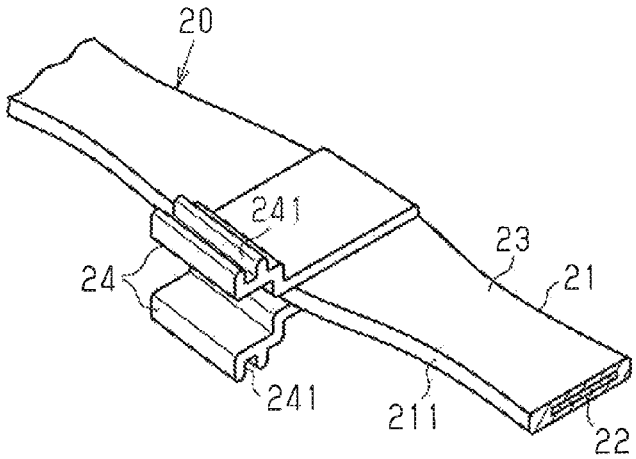
FIG. 17 is a partial perspective view which shows a second modified embodiment of the facial muscle exercising device.

In the constitution shown in FIG. 17, a pair of upper and lower mouth-held portions 24, each of which is formed in a flat plate shape, are formed on a covering material 23. Each of the mouth-held portions 24 projects to the front from the centers of both upper and lower faces of the covering material 23. A dent portion 241 held by the lips is formed on a tip upper face of the upper mouth-held portion 24 and on a tip lower face of the lower mouth-held portion 24. Even in this constitution, the mouth-held portions 24 can be held stably. Further, in the above-described constitution, the mouth-held portions 24 bend in the vertical direction, and an interval between the upper and lower mouth-held portions 24 can be changed appropriately by the size of the mouth and a holding force. Still further, elastic deformation of the mouth-held portions 24 can be used to give an additional load to a user.

Figure 18:
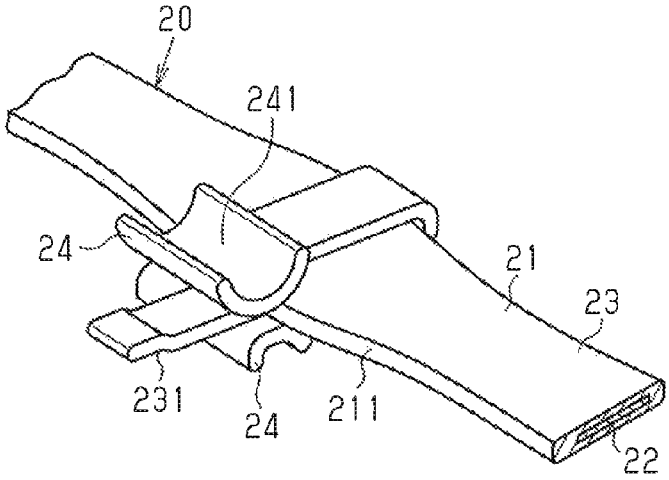
FIG. 18 is a partial perspective view which shows a third modified embodiment of the facial muscle exercising device.
Figure 19:
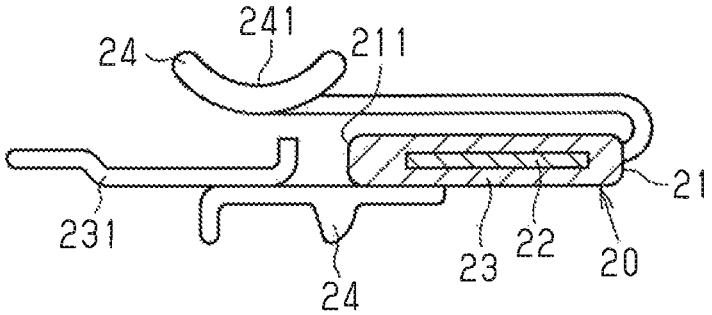
FIG. 19 is a longitudinal sectional view which shows the third modified embodiment of the facial muscle exercising device.

The constitution shown in FIG. 18 and FIG. 19 is similar to the constitution shown in FIG. 17. According to this constitution, a wider dent portion 241, which is held by the lips, is formed on a tip upper face of an upper mouth-held portion 24 and on a tip lower face of a lower mouth-held portion 24. Even in this constitution, the mouth-held portions 24 can be held stably. Further, a projected piece 231, which is inserted into the mouth to realize a stable holding state, is formed at the lower mouth-held portion 24. Therefore, according to the above constitution, as with the constitution shown in FIG. 17, the mouth-held portions 24 will bend in the vertical direction, by which an interval between the mouth-held portions 24 can be changed appropriately. Still further, elastic deformation of the mouth-held portions 24 is used to give an additional load to a user. In addition, with the tip of the tongue being touched at a lower face of a projected piece 231, the facial muscle exercising device is swayed, by which tongue muscles such as mylohyoid muscles can be exercised.

Figure 20:
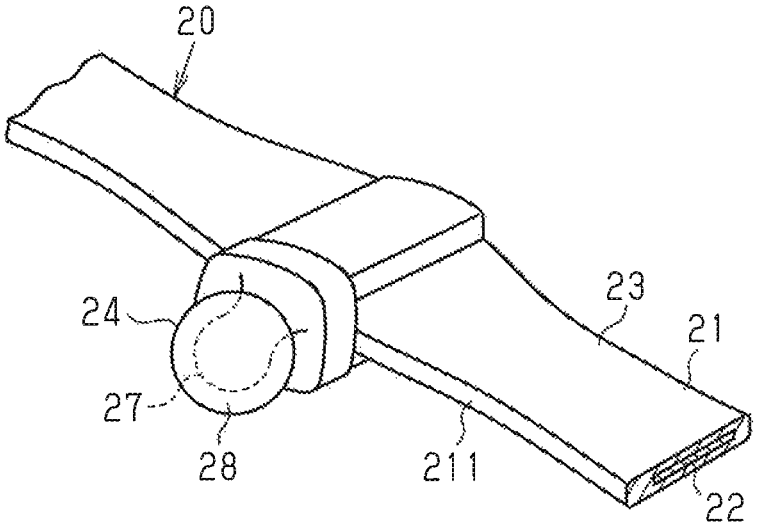
FIG. 20 is a partial perspective view which shows a fourth modified embodiment of the facial muscle exercising device.

In the constitution shown in FIG. 20, a mouth-held portion 24 is constituted with a spherical core 27 and a spherical-bag shaped mouth piece 28. The core 27 projects from the center of a front face of a covering material 23. A mouth piece 28 is attached to the core 27 in a detachable manner.

In the first and second embodiments, it is acceptable that the mouth-held portion 24 is formed integrally with the covering material 23.

It is acceptable that the weight 30 is omitted from the facial muscle exercising device 20. More specifically, it is acceptable that the covering material 23 is made larger or thicker at both ends thereof or increased in area and thickness, and the covering material 23 is formed integrally with the weight portion 25. In the constitution that is increased in area, the weight portion 25 is swayed to impart a large air resistance to the weight portion 25. In this case, the air resistance acts as a load to the lips, thus making it possible to obtain effective exercising effects.

It is acceptable that the mouth-held portion 24 of the second embodiment is made similar in constitution to that of the first embodiment.

Figure 21:
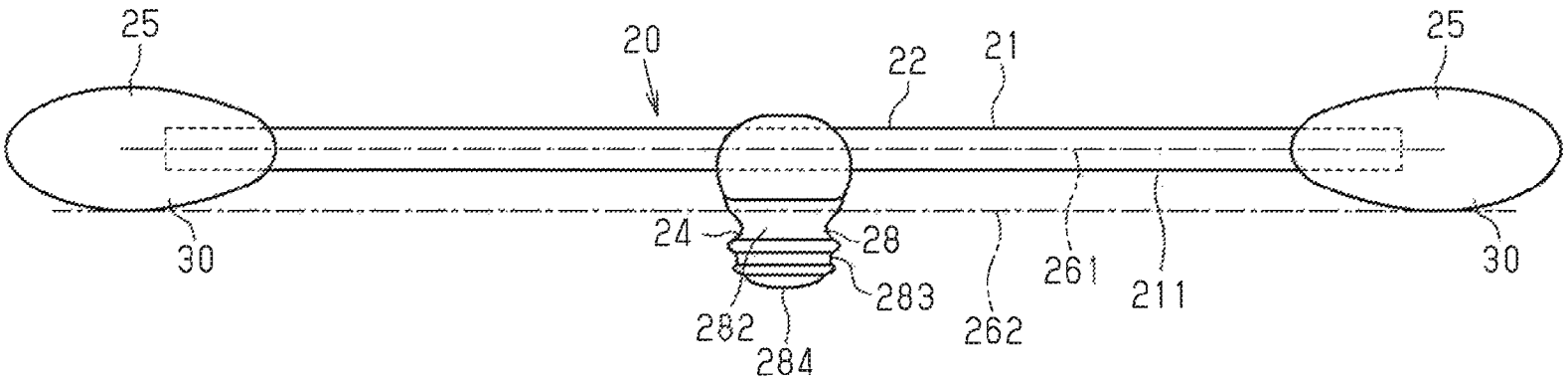
FIG. 21 is a plan view which shows a fifth modified embodiment of the facial muscle exercising device.

As shown in FIG. 21, it is acceptable that the covering material 23 that covers the elastic plate 22 is omitted from the facial muscle exercising device 20. In this case, the mouth-held portion 24 made of a synthetic resin is directly fixed on the elastic plate 22. It is also acceptable that the synthetic-resin made weight 30 that constitutes the weight portion 25 is directly fixed to the elastic plate 22. In this case, it is acceptable that the mouth-held portion 24 and the weight 30 are fixed on the elastic plate 22 by the use of screws. Further, it is acceptable that the weight 30 is constituted only with a metal material.

It is acceptable that without installing the weight 30 at the weight portion 25, in place of the weight 30, an end portion of the elastic plate 22 is wound around, folded or given a greater area so that the end portion of the elastic plate 22 may have a predetermined weight.

It is acceptable that the mouth piece 28 of the mouth-held portion 24 is formed such that an outer circumferential face thereof is formed simply in a cylindrical shape.

DESCRIPTION OF REFERENCE NUMERALS

21: facial muscle exercising device
22: elastic plate
222: corner portion
23: covering portion
24: mouth-held portion
25: weight portion
26: straight line as position of gravity center

27: attachment portion
28: mouth piece
29: retaining hole
30: weight

The invention claimed is:

1. A facial muscle exercising device, which is to be held by lips to exercise facial muscles, comprising:

a bending portion, which is elastically deformable and is formed in a long shape; and a mouth-held portion, which is arranged at the center of the bending portion and is to be held by the lips, wherein the mouth-held portion projects in a direction perpendicular to a direction in which the bending portion bends and is located outside an edge portion of the bending portion.

2. The facial muscle exercising device according to claim 1, wherein a weight portion is arranged at both ends of the bending portion.

3. The facial muscle exercising device according to claim 1, wherein:

the mouth-held portion defines a dent that encircles the mouth-held portion;

the dent receives the lips when the facial muscle exercising device is held by the lips; and the dent is displaced from the bending portion in the direction perpendicular to the direction in which the bending portion bends.

4. The facial muscle exercising device according to claim 3, wherein the facial muscle exercising device is configured to be held by the lips in a cantilever state with the lips in the dent and both the lips and the dent displaced from the bending portion in the direction perpendicular to the direction in which the bending portion bends and both the lips and the dent located outside the edge portion of the bending portion.

5. The facial muscle exercising device according to claim 2, wherein the bending portion comprises a leaf spring.

6. The facial muscle exercising device according to claim 5, wherein a protective piece that covers an edge of the leaf spring is installed at an end portion of the leaf spring.

7. The facial muscle exercising device according to claim 5, wherein the mouth-held portion is fixed to the leaf spring.

8. The facial muscle exercising device according to claim 7, wherein the mouth-held portion comprises a core, which is fixed to the leaf spring, and a mouth piece, which is attached outside the core in a detachable manner.

9. The facial muscle exercising device according to claim 8, wherein the inner circumferential face of the retaining hole or the outer circumferential face of the weight comprises a satin-like surface finish.

10. The facial muscle exercising device according to claim 8, wherein an open portion is formed on the outer circumference of the core.

11. The facial muscle exercising device according to claim 8, wherein a portion of the mouth piece held by the lips is located outside from a line connecting width ends of the weight portions.

12. The facial muscle exercising device according to claim 11, wherein a weight is attached to the weight portion in a detachable manner.

13. The facial muscle exercising device according to claim 12, wherein the weight is attached into a retaining hole in a detachable manner.

14. The facial muscle exercising device according to claim 13, wherein the outer circumferential face of the core or the inner circumferential face of the mouth piece comprises a satin-like surface finish.

* * * * *